US006344824B1

(12) United States Patent
Takasugi et al.

(10) Patent No.: US 6,344,824 B1
(45) Date of Patent: Feb. 5, 2002

(54) NONCONTACT COMMUNICATION SEMICONDUCTOR DEVICE

(75) Inventors: Wasao Takasugi, Higashiyamato; Fumiyuki Inose, Tokorozawa, both of (JP)

(73) Assignee: Hitachi Maxell, Ltd., Osaka (JP)

( * ) Notice: Subject to any disclaimer, the term of this patent is extended or adjusted under 35 U.S.C. 154(b) by 0 days.

(21) Appl. No.: 09/762,216

(22) PCT Filed: Sep. 16, 1999

(86) PCT No.: PCT/JP99/05037

§ 371 Date: Feb. 5, 2001

§ 102(e) Date: Feb. 5, 2001

(87) PCT Pub. No.: WO00/17813

PCT Pub. Date: Mar. 3, 2000

(30) Foreign Application Priority Data

Sep. 18, 1998 (JP) ..... 10-265175

(51) Int. Cl.[7] ..... H01Q 1/26

(52) U.S. Cl. ..... 343/700 MS; 343/742; 235/491; 257/679; 340/572.7

(58) Field of Search ..... 343/700 MS, 702, 343/741, 742, 866, 867, 895; 235/487, 491; 257/679, 778; 340/572.7, 572.8

(56) References Cited

U.S. PATENT DOCUMENTS 5,710,458 A * 1/1998 Iwasaki ..... 257/679
5,955,776 A 9/1999 Ishikawa ..... 257/618
6,249,242 B1 * 6/2001 Sekine et al. ..... 342/70
2001/0020896 A1 * 9/2001 Higuchi ..... 340/572.7

FOREIGN PATENT DOCUMENTS

| | | | | |
|---|---|---|---|---|
| JP | 01077202 | * | 3/1989 | ..... H01P/5/08 |
| JP | 07176646 | * | 7/1995 | ..... H01L/23/12 |
| JP | A887580 | | 4/1996 | |
| JP | A10231679 | | 9/1998 | |
| JP | 2000348153 | * | 12/2000 | ..... G06K/19/07 |
| WO | A1-9825090 | | 6/1998 | |

* cited by examiner

*Primary Examiner*—Tho Phan
(74) *Attorney, Agent, or Firm*—Birch, Stewart, Kolasch & Birch, LLP

(57) ABSTRACT

A compact noncontact communication semiconductor device having a multidirectional or omnidirectional antenna and usable in a minuscule space to which the applications have conventionally been difficult is provided. The outer peripheral portion of a spherical IC 1 is covered with an insulating layer 4 having a thickness equal to or larger than the diameter of the IC 1, and antenna patterns 2 are formed on the surface of the insulating layer 4. The antenna patterns 2 can be configured either with a winding or by microprocessing using etching or laser beam, for example, for the conductive film formed on the surface of the insulating layer 4. The antenna patterns 2 and the circuit pattern formed on the surface of the IC 1 are interconnected via a through hole 5.

6 Claims, 5 Drawing Sheets

NONCONTACT COMMUNICATION SEMICONDUCTOR DEVICE

This application is the national phase under 35 U.S.C. § 371 of PCT International Application No. PCT/JP99/05037 which has an International filing date of Sep. 16, 1999, which designated the United States of America.

TECHNICAL FIELD

The present invention relates to a noncontact communication semiconductor device comprising a radio communication antenna for handling comparatively weak signals, in which power is received from a reader-writer and signals are supplied to and received from the reader-writer by radio.

BACKGROUND ART

Conventionally, a semiconductor device comprising an IC chip mounted on a substrate formed in the shape of card, tag or coin is known. This type of semiconductor device has a wealth of information amount and a high security performance, and therefore has come to be widely used in various fields including traffic, distribution and data communication.

Especially, a recently-developed noncontact communication semiconductor device, in which the supply of power from a reader-writer to an IC chip and the transmission/reception of signals between a reader-writer and an IC chip are performed in a noncontact fashion using a radio-communication antenna without providing any external terminal on the substrate, has the features that it is basically free of breakage of the external terminal unlike the contact, easy to store or otherwise handle, and has a long service life and the maintenance of the reader-writer is easy. Another feature is that the data cannot be easily altered for an improved security performance, and therefore future extension of the use thereof is expected in wider areas of application.

In the conventional noncontact communication semiconductor device, an IC chip with a flat circuit-forming surface, i.e. an IC chip in a thin tabular form of silicon wafer with one side thereof is formed of a required circuit pattern including arithmetic elements and storage elements. Also, a flat coil comprised of a winding coil of a conductor or a flat coil with a conductor film etched has been used as an antenna for radio communication. These antennas are generally mounted on a substrate. In recent years, however, a flat coil directly formed as a pattern on an IC chip or a coil wound around an IC chip as a core has been proposed.

A thin tabular IC chip with a required circuit pattern integrated on one side of a silicon wafer has a small bending strength. Therefore, a device with an antenna mounted on an IC chip, to say nothing of a device with an antenna mounted on a substrate, cannot be used by itself as a noncontact communication semiconductor device, but an IC chip is required to be mounted on a substrate. Thus the conventional noncontact communication semiconductor device has the disadvantage that the structure is complicated for an increased cost and the superficial shape becomes bulky.

Also, the conventional noncontact communication semiconductor device, in which the substrate is formed in the shape of card, tag or coin and the antenna mounted on the device has a directivity between the front and back sides of the substrate, naturally has a limited field of application. For example, the conventional noncontact communication semiconductor device cannot be placed and used in a fluid for measuring the flow rate and flow velocity.

DISCLOSURE OF THE INVENTION

The present invention has been developed to obviate this problem of the prior art, and the object of the invention is to provide a noncontact communication semiconductor device which can be produced in small size at low cost and is applicable to fields to which the application has thus far been difficult.

In order to solve the aforementioned problem, the present invention uses an IC having a three-dimensional circuit-forming surface and is so configured that an antenna for radio communication is formed as a three-dimensional pattern on the surface of the particular IC or an antenna for radio communication electrically connected to the input/output terminal of a circuit three-dimensionally formed on the circuit-forming surface is attached to the outer peripheral portion of the IC having the three-dimensional circuit-forming surface.

The aforementioned IC having a three-dimensional circuit-forming surface, unlike the IC produced by the wafer process, is fabricated in such a manner that required elements and wiring are formed using the process technique on the surface of a silicon base generated by a special method. Such an IC, in which the contour is configured with at least two flat surfaces, is of two types. One has a contour containing at least two surfaces on which the circuits are formed. The other has a contour formed as a curved surface in the shape of sphere, grain, dish, hemoglobin, tetrapod, elongate or flat ellipsoid of revolution, tetrahedron enclosure, cubic, donuts, rice grain, gourd, seal or barrel, on which curved surface the circuits are formed.

In the noncontact communication semiconductor device described above, an insulating layer may be formed as required between the IC and the antenna, and by adjusting the thickness of the insulating layer, the size, i.e. the frequency characteristic of the antenna formed on the surface of the insulating layer can be adjusted.

Of the two types of semiconductor devices described above, the semiconductor device with a radio communication antenna attached to the outer peripheral portion of the IC having a three-dimensional circuit-forming surface may be such that the particular antenna is configured with either two conductive hollow hemispheric members with the peripheral edge portions thereof arranged in opposed relation to each other through a predetermined slit, or a conductive hollow spherical member having a slit in a portion thereof. These antennas have a superior high-frequency characteristic and therefore can secure a long communication distance in spite of their small size. Also, in the case where the required communication distance is short, an antenna formed of a winding coil can be used.

In the case where the antenna described above is a winding coil or a pattern formed by the microprocessing technique such as the laser beam machining or etching on the IC surface, an arbitrary antenna pattern including the loop or dipole or a combination of the two can be used. Also, the antenna pattern is desirably multidirectional or omnidirectional, and formed to have a high sensitivity at least in three or more specific directions.

An IC having a three-dimensional circuit-forming surface such as a spherical IC has a much higher bending strength (breaking strength) than a tabular IC chip. In the case where a radio communication antenna is formed as a pattern on the surface of such an IC or a radio communication antenna is attached to the outer peripheral portion of the IC, the substrate on which the antenna is to be mounted is not required. As compared with the conventional noncontact communication semiconductor device requiring the substrate as an essential component part, therefore, the superficial shape thereof can be reduced in size remarkably, while at the same time making it possible to form a multidirectional or omnidirectional antenna having a high sensitivity in three or more specific directions. Thus, a noncontact communication semiconductor device can be configured with only an IC and an antenna. This semiconductor device, being compact and in the shape of grain, can be placed and used in a fluid, for example, for measuring the flow rate and the flow velocity. The application field of the noncontact communication semiconductor device of this type can thus be extended. Further, in view of the fact that the desired noncontact communication semiconductor device can be produced simply by forming a radio communication antenna as a pattern on the surface of the IC or by attaching a radio communication antenna to the outer peripheral portion of the IC, a noncontact communication semiconductor device can be produced at lower cost than the noncontact communication semiconductor device having a substrate.

BEST MODE FOR CARRYING OUT THE INVENTION

Figure 1:
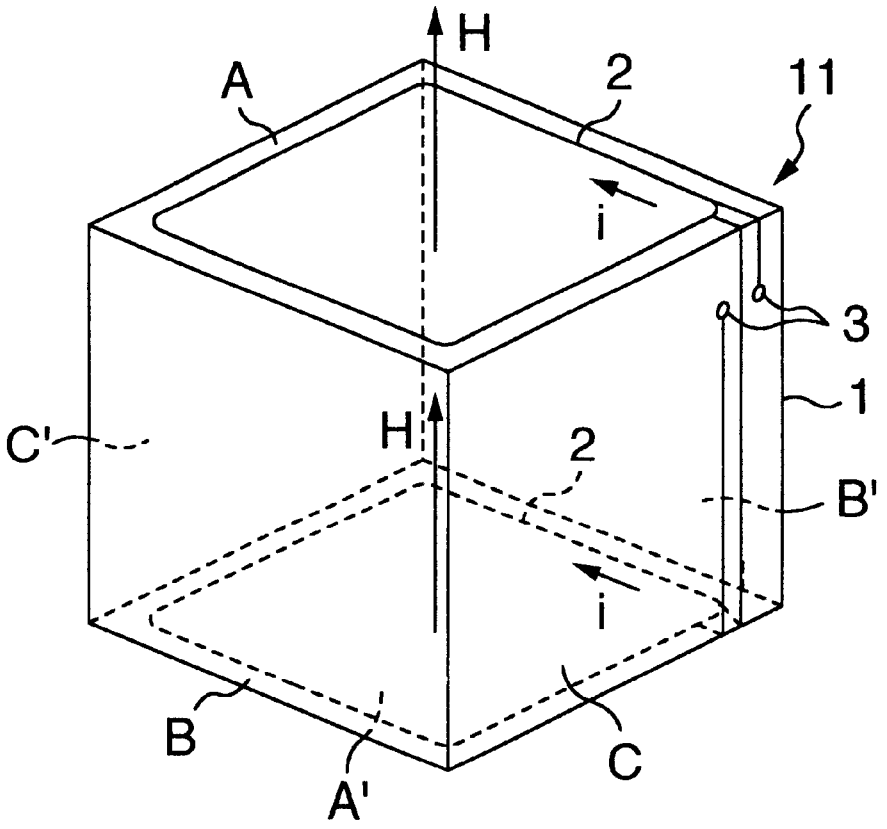
FIG. 1 is a perspective view of a noncontact communication semiconductor device according to a first embodiment.
Figure 2A:
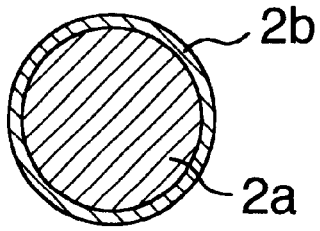
FIGS. 2A, 2B are sectional views of a conductor making up an antenna.
Figure 2B:
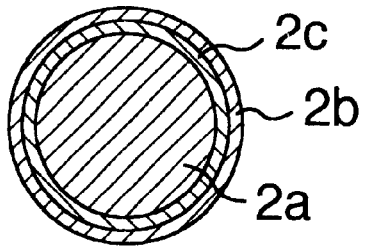
Figure 3:
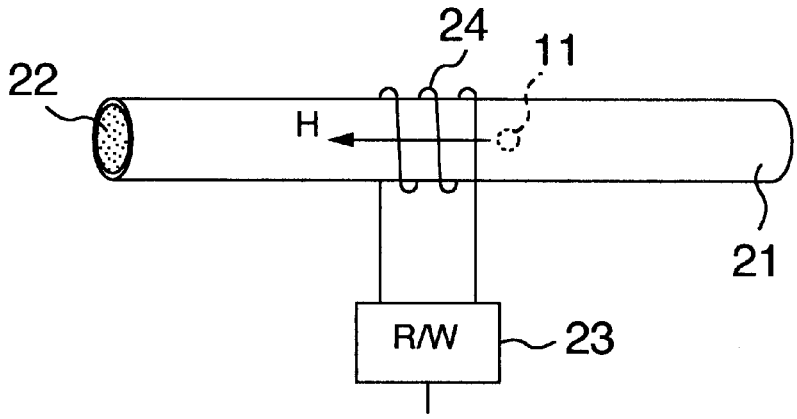
FIG. 3 is a schematic diagram for explaining an example of application of the noncontact communication semiconductor device and an example of a configuration of a reader-writer according to the first embodiment.

A noncontact communication semiconductor device according to a first embodiment of the present invention will be explained with reference to FIGS. 1 to 3. FIG. 1 is a perspective view of a noncontact communication semiconductor device according to a first embodiment, FIGS. 2A, 2B are sectional views of a conductor making up an antenna, and FIG. 3 is a schematic diagram for explaining an example of application of a noncontact communication semiconductor device and an example of configuration of a reader-writer according to the first embodiment.

As apparent from FIG. 1, a noncontact communication semiconductor device 11 according to this embodiment has an antenna pattern 2 formed on each of the surface A and the surface A' opposed to the surface A of a three-dimensionally formed IC 1, and the ends 3 of the antenna are arranged on the surface C orthogonal to the surfaces A and A'. The antenna patterns 2 formed on the surfaces A and A' are both wound in the same direction with respect to a current i, so that when the current i is supplied to the antenna patterns 2, a magnetic field H in the same direction normal to the surfaces A and A' is generated from each antenna pattern 2. Incidentally, although the antenna patterns 2 are each shown by a single line in the drawing, a predetermined number of turns can be wound in the form of coil.

The IC 1 formed in cube as described above, and at least two of the six surfaces making up the cube are formed with a required circuit pattern (not shown), and the portions of the surface C corresponding to the antenna ends 3 have an input/output port. This IC 1 is formed by forming required elements and wiring using the process technique on the surface of the cubic silicon base.

The antenna patterns 2 can be configured either by winding a conductor around the IC 1, or by microprocessing, such as etching or applying a laser beam to the conductive film formed on the surface of the IC 1 through an insulating layer (not shown). In the case where the antenna patterns 2 are formed of a conductor, the portion of the surface C of the IC 1 corresponding to the ends 3 of the antenna is formed with a pad to which the ends of the antenna 2 are connected. Such a pad is not required in the case where the antenna patterns 2 are formed by microprocessing the conductive film.

In the case where the antenna patterns 2 are formed of a conductor, the conductor may be a wire member configured with a core wire 2*a* of a metal material of a good conductor such as copper or aluminum covered with an insulating layer 2*b* of resin or the like as shown in FIG. 2A, or a wire member configured with a core wire 2*a* covered with a bonding metal layer 2*c* such as gold or solder which in turn is covered with an insulating layer 2*b* as shown in FIG. 2B. The diameter of the wire member, though appropriately selectable as required, is most suitably 20 $\mu$m to 100 $\mu$m in view of the need of preventing the breakage of the winding and reducing the size of the antenna unit. Also, the antenna patterns 2 made of a conductor and the IC pad can be connected to each other by a method such as wire bonding, soldering, ultrasonic fusion or connection of an anisotropic conductor.

In the noncontact communication semiconductor device 11 according to this embodiment, the radio communication antennas 2 are formed as a pattern or a coil is wound on the surface of the cubic IC 1. Unlike in the prior art, therefore, a substrate for mounting the antennas thereon is not required, so that the tabular form can be remarkably reduced in size as compared with the conventional noncontact communication semiconductor device comprising a substrate as an essential part. As a result, a practical noncontact communication semiconductor device can be configured simply with the IC 1 and the antennas 2. This device is small and granular, and therefore, as shown in FIG. 3, can be put into a fluid 22 flowing in the tube 21 for allowing the reader-writer 23 to measure the flow rate and the flow velocity thereof.

Specifically, the reader-writer 23 has a coil 24 adapted to be electromagnetically coupled to the antennas 2 of the noncontact communication semiconductor device 11, which coil 24 is wound on the outer periphery of the tube member 21. With the reader-writer 23 having this configuration, the noncontact communication semiconductor device 11 that has flowed in the tube member 21 together with the fluid 22 approaches the coil 24, and is supplied with power from the reader-writer 23 when the antennas 2 of the noncontact communication semiconductor device 11 are electromagnetically coupled to the coil 24. Using this power, the noncontact communication semiconductor device 11 performs the required arithmetic operation and transmits the required signal to the reader-writer 23. The receiving level of the signal of the reader-writer 23 is varied with the relative positions of the antennas 2 and the coil 24. By detecting the change of the receiving level by a host computer connected to the reader-writer 23, therefore, the velocity and hence the flow rate of the fluid 22 flowing in the tube member 21 can be determined by the arithmetic operation.

Further, the noncontact communication semiconductor device having the configuration described above can be obtained in the desired form simply by forming patterns of a radio communication antenna or by winding a wire coil on the surface of the IC, and therefore can be produced at lower cost than the noncontact communication semiconductor device having a substrate.

Figure 4:
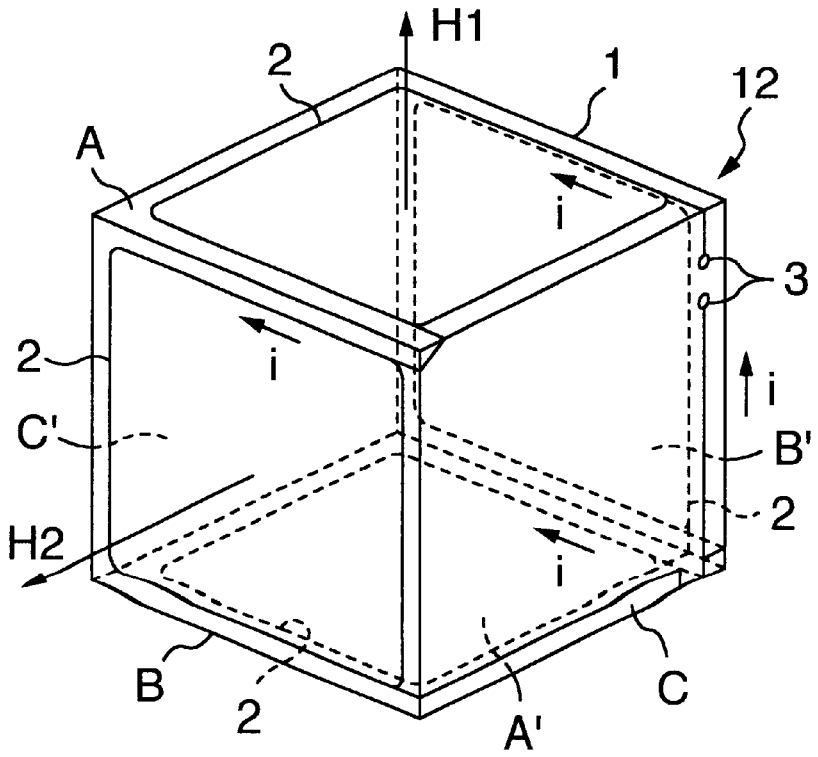
FIG. 4 is a perspective view of a noncontact communication semiconductor device according to a second embodiment.

A noncontact communication semiconductor device according to a second embodiment of the invention will be explained with reference to FIG. 4. FIG. 4 is a perspective view of a noncontact communication semiconductor device according to the second embodiment.

As apparent from FIG. 4, in a noncontact communication semiconductor device 12 according to this embodiment, an antenna pattern 2 is formed on each of the surfaces A, A' and surfaces B, B' orthogonal to the surfaces A, A' of the IC 1 formed in cube, and the ends of the antennas are arranged on the surface C orthogonal to the surfaces A, A' and the surfaces B, B'. The antenna patterns 2 formed on the surfaces A and A' of the IC 1 are both wound in the same direction with respect to the current i, so that when the current i is supplied to the antenna patterns 2, a magnetic field H1 is generated in the same direction normal to the surfaces A and A' from each antenna pattern 2. The antenna patterns 2 formed on the surfaces B and B' are also wound in the same direction with respect to the current i, so that when the current i is supplied to the antenna patterns 2, a magnetic field H2 is generated in the same direction normal to the surfaces B and B' from each antenna pattern 2. The other functions are the same as those of the noncontact communication semiconductor device 11 according to the first embodiment and will not be described to avoid duplication.

The noncontact communication semiconductor device 12 according to this embodiment exhibits the same effect as the noncontact communication semiconductor device 11 according to the first embodiment, and the antenna patterns 2 are formed on the surfaces A, A' and the surfaces B, B' of the IC 1. Therefore, there can be obtained a noncontact communication semiconductor device equipped with a multidirectional antenna unit having a high sensitivity in two directions perpendicular to the surfaces A, A' and the surfaces B, B'.

Figure 5:
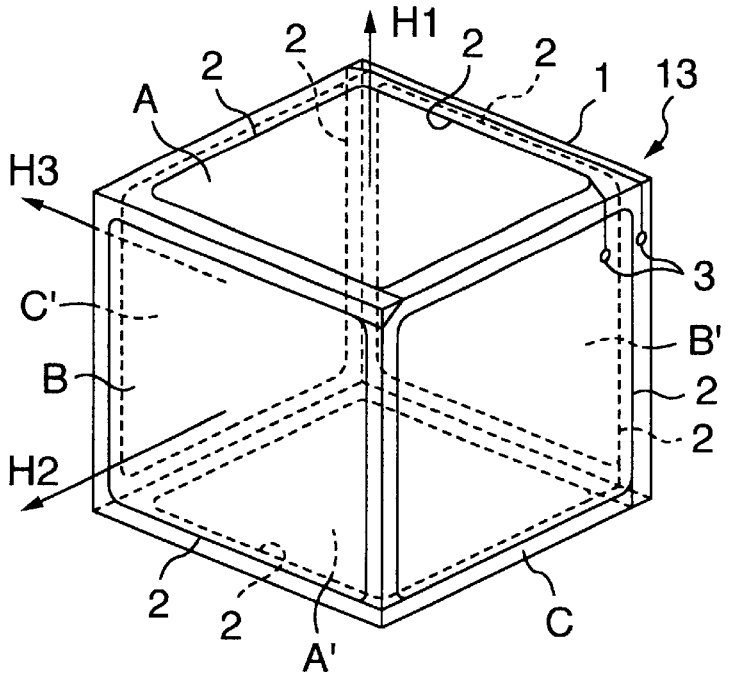
FIG. 5 is a perspective view of a noncontact communication semiconductor device according to a third embodiment.

A noncontact communication semiconductor device according to a third embodiment of the present invention will be explained with reference to FIG. 5. FIG. 5 is a perspective view of a noncontact communication semiconductor device according to the third embodiment.

As apparent from FIG. 5, the noncontact communication semiconductor device according to the third embodiment 13 has antenna patterns 2 formed on the surfaces A, A', the surfaces B, B' and the surfaces C, C' of the IC 1 formed in cube, and the ends 3 of the antennas are arranged on the surface C. The antenna patterns 2 formed on the surfaces A, A' of the IC 1 are both wound in the same direction with respect to the current i, so that when the current i is supplied to the antenna patterns 2, a magnetic field Hi is generated in the same direction normal to the surfaces A, A' from each antenna pattern 2. The antenna patterns 2 formed on the surfaces B, B' are also wound in the same direction with respect to the current i, so that when the current i is supplied to the antenna patterns 2, a magnetic field H2 is generated in the same direction normal to the surfaces B, B' from each antenna pattern 2. Further the antenna patterns 2 formed on the surfaces C, C' are also wound in the same direction with respect to the current i, so that when the current i is supplied to the antenna patterns 2, a magnetic field H3 is generated in the same direction normal to the surfaces C, C' from each antenna pattern 2. The other functions are the same as those of the noncontact communication semiconductor device 11 according to the first embodiment and will not be described to avoid duplication.

The noncontact communication semiconductor device 13 according to this embodiment exhibits the same effect as the noncontact communication semiconductor device 11 according to the first embodiment, and the antenna patterns 2 are formed on the surfaces A, A', the surfaces B, B' and the surfaces C, C' of the IC 1. Therefore, there can be obtained a noncontact communication semiconductor device equipped with a multidirectional antenna unite having a high sensitivity in three directions perpendicular to the surfaces A, A', the surfaces B, B' and the surfaces C, C'.

Figure 6:
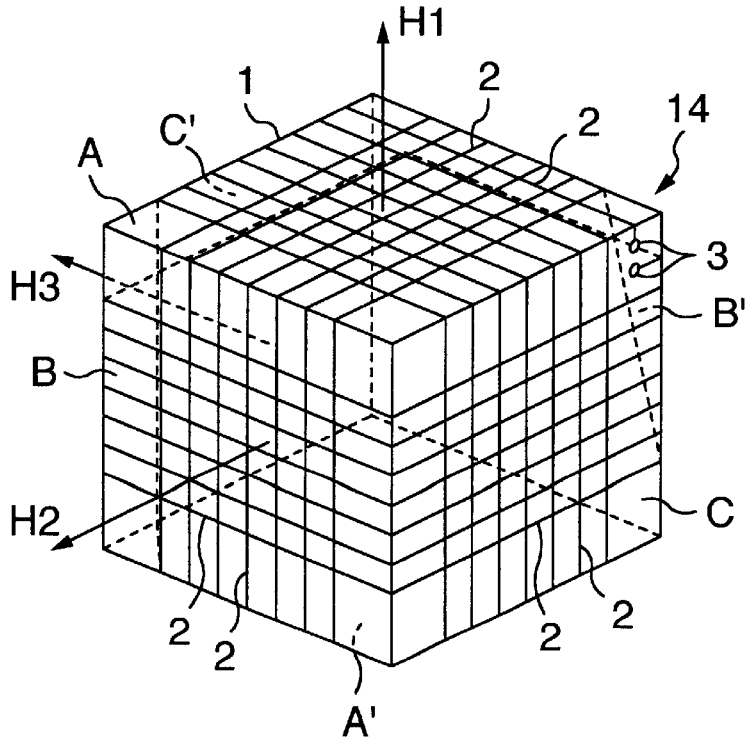
FIG. 6 is a perspective view of a noncontact communication semiconductor device according to a fourth embodiment.

A noncontact communication semiconductor device according to a fourth embodiment of the present invention will be explained with reference to FIG. 6. FIG. 6 is a perspective view of a noncontact communication semiconductor device according to the fourth embodiment.

As apparent from FIG. 6, the noncontact communication semiconductor device 14 according to this embodiment is characterized in that antenna patterns 2 are continuously formed in three directions on the peripheral surfaces of the IC 1 formed in cube, and the ends 3 of the antennas are arranged on a given one of the surfaces, or the surface C in the shown case. The antenna patterns 2 can be formed by winding a conductor as illustrated in FIG. 2. In the noncontact communication semiconductor device 14 according to this embodiment, when a current i is supplied to the antenna patterns 2, three magnetic fields H1, H2 and H3 orthogonal to each other are generated in three directions from the coils wound on the respective peripheral surfaces of the IC 1. The other functions are the same as those of the noncontact communication semiconductor device 11 according to the first embodiment and will not be described to avoid duplication.

The noncontact communication semiconductor device 14 according to this embodiment exhibits a similar effect to the noncontact communication semiconductor device 13 according to the third embodiment.

Figure 7A:
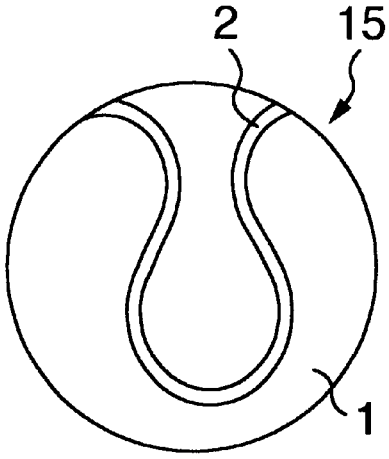
FIGS. 7A, 7B are perspective views of a noncontact communication semiconductor device according to a fifth embodiment.
Figure 7B:
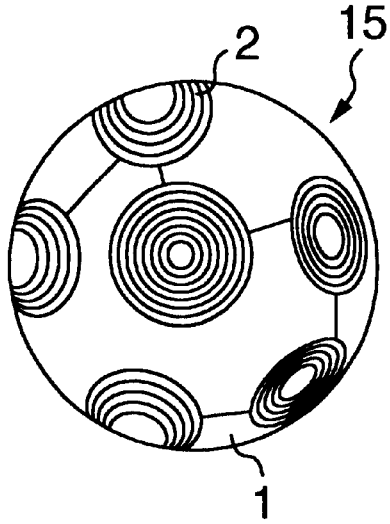

A noncontact communication semiconductor device according to a fifth embodiment of the invention will be explained with reference to FIGS. 7A, 7B. FIGS. 7A, 7B are perspective views of a noncontact communication semiconductor device according to the fifth embodiment.

As apparent from FIGS. 7A, 7B, the noncontact communication semiconductor device 15 according to this embodiment is characterized in that an IC having a spherical contour is used as an IC 1 and an antenna pattern 2 is formed on the surface of the IC 1. The antenna pattern 2 can be configured with a winding or by microprocessing using etching or laser beam for the conductive film formed on the surface of the IC 1 through an insulating layer (not shown). FIG. 7A is an example in which the antenna 2 is formed along the surface of the IC 1 in the shape of the seam of a baseball, and FIG. 7B an example in which a plurality of spiral coils are distributed over the surface of the IC 1. In either case, there can be obtained a noncontact communication semiconductor device including a multidirectional antenna having a high sensitivity in two or more multiple directions. The other functions are the same as those of the noncontact communication semiconductor device 11 according to the first embodiment and therefore will not be described to avoid duplication.

The noncontact communication semiconductor device 15 according to this embodiment also exhibits a similar effect to the noncontact communication semiconductor devices 11, 12, 13, 14 according to the first to fourth embodiments, respectively.

Figure 8:
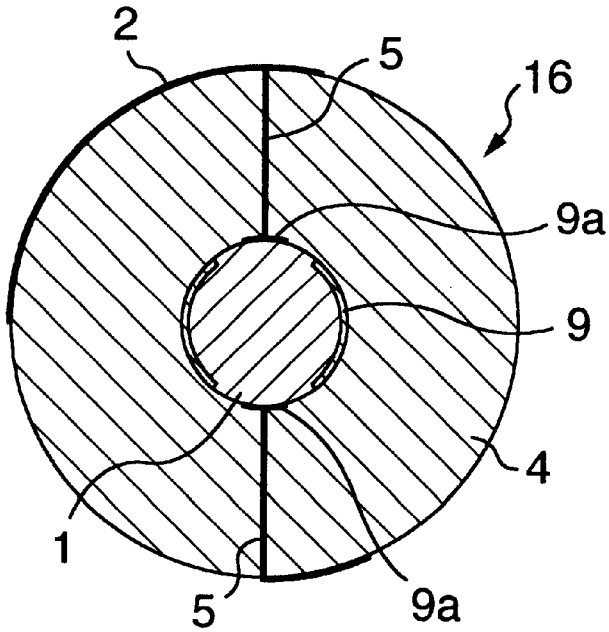
FIG. 8 is a sectional view of a noncontact communication semiconductor device according to a sixth embodiment.

A noncontact communication semiconductor device according to a sixth embodiment of the invention will be explained with reference to FIG. 8. FIG. 8 is a sectional view of a noncontact communication semiconductor device according to the sixth embodiment.

As apparent from FIG. 8, the noncontact communication semiconductor device 16 according to this embodiment is characterized in that the outer peripheral portion of a spherical IC 1 is covered with an insulating layer 4 having a thickness equal to or larger than the diameter of the IC 1, and an antenna pattern 2 is formed on the surface of the insulating layer 4. The antenna pattern 2 may be either configured of a winding or configured by microprocessing such as machining by etching or a laser beam for the conductive film formed on the surface of the insulating layer 4. The antenna pattern 2 is connected via through holes 5 to input/output ports 9*a* of the circuit pattern 9 formed on the surface of the IC 1. The other functions are the same as those of the noncontact communication semiconductor device 11 according to the first embodiment and therefore will not be described to avoid duplication.

In the noncontact communication semiconductor device 16 according to this embodiment, which has a similar effect to the noncontact communication semiconductor device 15 according to the fifth embodiment, the outer peripheral surface of the spherical IC 1 is covered with the insulating layer 4 having a thickness equal to or larger than the diameter of the IC 1 and an antenna pattern 2 is formed on the surface of the insulating layer 4. Therefore, the size of the antenna pattern 2 can be increased as compared with the case in which the antenna pattern 2 is formed on or in the neighborhood of the surface of the IC 1, thereby making it provide a noncontact communication semiconductor device having an antenna superior in high-frequency characteristic.

Figure 9:
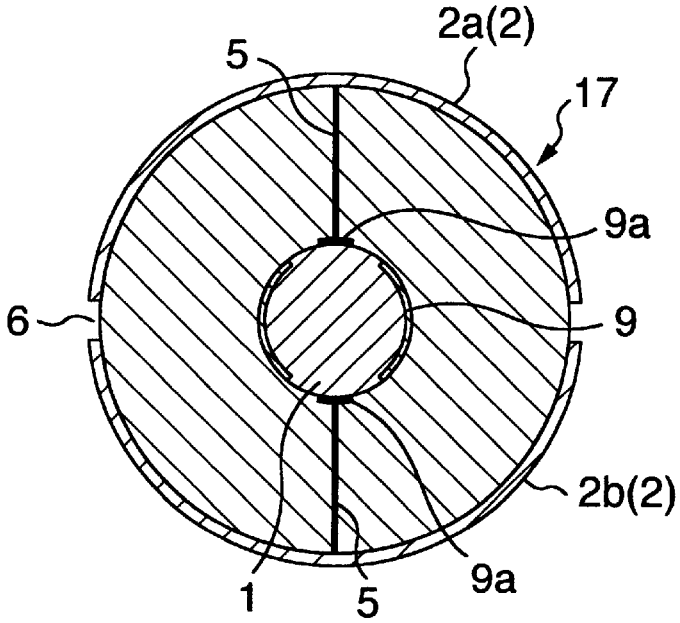
FIG. 9 is a sectional view of a noncontact communication semiconductor device according to a seventh embodiment.

A noncontact communication semiconductor device according to a seventh embodiment of the invention will be explained with reference to FIG. 9. FIG. 9 is a sectional view of a noncontact communication semiconductor device according to the seventh embodiment.

As apparent from FIG. 9, the noncontact communication semiconductor device 17 according to this embodiment is characterized in that the outer peripheral portion of a spherical IC 1 is covered with an insulating layer 4 having a thickness equal to or larger than the diameter of the IC 1, and an antenna 2 including two conductive hollow hemispherical members 2*a*, 2*b* is deposited on the outer surface of the insulating layer 4. A predetermined gap 6 is formed between the opposed peripheral edge portions of the two conductive hollow hemispherical members 2*a*, 2*b*. Each of the conductive hollow hemispherical members 2*a*, 2*b* is connected via through holes 5 to the circuit pattern formed on the surface of the IC 1. The other functions are the same as those of the noncontact communication semiconductor device 16 according to the sixth embodiment and therefore will not be described to avoid duplication.

The noncontact communication semiconductor device 17 according to this embodiment, which has a similar effect to the noncontact communication semiconductor device 16 according to the sixth embodiment, uses the antenna 2 configured with the two conductive hollow hemispherical members 2*a*, 2*b*, and therefore can provide a noncontact communication semiconductor device equipped with an antenna having a superior high-frequency characteristic as compared with the case of using an antenna formed as a pattern or an antenna configured with a winding.

Figure 10:
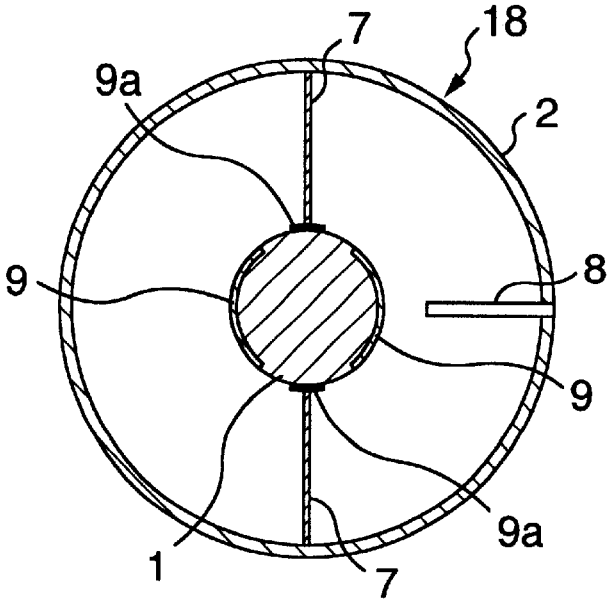
FIG. 10 is a sectional view of a noncontact communication semiconductor device according to an eighth embodiment.

A noncontact communication semiconductor device according to an eighth embodiment of the invention will be explained with reference to FIG. 10. FIG. 10 is a sectional view of a noncontact communication semiconductor device according to the eighth embodiment.

As apparent from FIG. 10, the noncontact communication semiconductor device 18 according to this embodiment is characterized in that a conductive hollow spherical member having a slit 8 in a portion thereof is used as an antenna 2, a spherical IC 1 is contained in the antenna 2, and two points on the inner surface of the antenna 2 are connected by conductors 7 to the circuit pattern formed on the surface of the IC 1. The other functions are the same as those of the noncontact communication semiconductor device 16 according to the sixth embodiment and therefore will not be described to avoid duplication.

The noncontact communication semiconductor device 18 according to this embodiment also has a similar effect to the noncontact communication semiconductor device 17 according to the seventh embodiment.

Although a cubic IC 1 or a spherical IC 1 is used in the embodiments described above, the invention is not limited to such shapes of the IC 1, but can use an IC having a three-dimensional circuit-forming surface with any arbitrary contour in the shape of grain, dish, hemoglobin, tetrapod, elongate ellipsoid of revolution, tetrahedron enclosure, donuts, rice grain, gourd, seal or barrel.

INDUSTRIAL APPLICABILITY

As described above, in a noncontact communication semiconductor device according to this invention, using an IC having a three-dimensional circuit-forming surface, a radio communication antenna is formed as a pattern on the surface of an IC or a radio communication antenna electrically connected with the input/output terminals of the circuit formed on the circuit-forming surface of the IC is attached on the outer peripheral portion of the IC. Therefore, the superficial shape of the noncontact communication semiconductor device can be remarkably reduced in size without the substrate for mounting the antenna thereon as compared with the conventional noncontact communication semiconductor device having a substrate as an essential component part, while at the same time making it possible to form a multidirectional antenna or an omnidirectional antenna having a high sensitivity in three or more multiple directions. As a result, a practical noncontact communication semiconductor device can be configured with only an IC and an antenna. At the same time, being compact and in the shape of grain, applications to the fields in which the conventional noncontact communication semiconductor device is difficult to use such as measurement of the flow rate and flow velocity within a fluid are made possible. Also, the absence of a substrate simplifies the structure and makes possible production at a lower cost than the conventional noncontact communication semiconductor device having a substrate.

What is claimed is:

1. A noncontact communication semiconductor device characterized by comprising an IC having a three-dimensional circuit-forming surface and a radio communication antenna formed as a three-dimensional pattern on the surface of said IC.

2. A noncontact communication semiconductor device as described in claim 1, characterized in that said IC has a curved contour surface.

3. A noncontact communication semiconductor device as described in claim 2, characterized in that said IC is spherical.

4. A noncontact communication semiconductor device as described in claim 1, characterized in that an insulating layer is interposed between said IC and said antenna.

5. A noncontact communication semiconductor device characterized by comprising an IC having a three-dimensional circuit-forming surface and a radio communication antenna attached on the outer peripheral surface of said IC and electrically connected to the input/output terminals of the circuit formed three-dimensionally on said circuit-forming surface, wherein said antenna is configured with two conductive hollow hemispherical members, and the peripheral edge portions of these two conductive hollow hemispherical members are arranged in opposed relation to each other through a predetermined slit.

6. A noncontact communication semiconductor device characterized by comprising an IC having a three-dimensional circuit-forming surface and a radio communication antenna attached on the outer peripheral surface of said IC and electrically connected to the input/output terminals of the circuit formed three-dimensionally on said circuit-forming surface, wherein said antenna is configured with a conductive hollow spherical member having a slit in a portion thereof.

* * * * *